US005825280A

United States Patent [19]

Merendini et al.

[11] Patent Number: 5,825,280

[45] Date of Patent: Oct. 20, 1998

[54] PORTABLE SAFETY LIGHT AND AUDIBLE SIGNAL APPARATUS

[76] Inventors: Andrew Vito Merendini, 497 Wild Ave., Staten Island, N.Y. 10314; John A. Oddo, 131 Old Town Rd., Staten Island, N.Y. 10304; Dennis A. Petosa, 2190 Richmond Rd., Staten Island, N.Y. 10306

[21] Appl. No.: 529,068

[22] Filed: Sep. 15, 1995

[51] Int. Cl.[6] ..... G08B 27/00

[52] U.S. Cl. ..... 340/326; 340/321; 340/328; 340/329; 340/331; 340/332; 340/539

[58] Field of Search ..... 340/326, 321, 340/328, 329, 331, 332, 539; 116/202

[56] References Cited

U.S. PATENT DOCUMENTS

| | | | |
|---|---|---|---|
| 3,201,771 | 8/1965 | Proulx | 340/321 |
| 3,693,110 | 9/1972 | Briggs et al. | 340/328 |
| 3,916,404 | 10/1975 | Gouge | 340/371 |
| 4,072,925 | 2/1978 | Yashima et al. | 340/461 |
| 4,090,185 | 5/1978 | Patty | 340/321 |
| 4,224,602 | 9/1980 | Anderson et al. | 340/321 |
| 5,132,659 | 7/1992 | Koto | 340/326 |

*Primary Examiner*—Thomas J. Mullen, Jr.
*Assistant Examiner*—Julie B. Lieu
*Attorney, Agent, or Firm*—Rodger H. Flagg

[57] ABSTRACT

A portable safety light and audible signal apparatus for placement in proximity to a building exit, to guide one or more fire fighters and emergency personnel to the exit during conditions of intense smoke and heat. The portable safety light and audible signal apparatus has a housing for containing, an audible signal generator capable of generating at least three distinctive audible signals, a strobe light mounted upon the top portion of the housing; an inverted U-shaped handle mounted on opposing sides of the strobe light, at least one switch in electrical communication with the strobe light and the audible signal generator, and a portable power supply located within the housing, in electrical communication with the switch.

18 Claims, 2 Drawing Sheets

PORTABLE SAFETY LIGHT AND AUDIBLE SIGNAL APPARATUS

FIELD OF THE INVENTION

This invention pertains to a portable safety light and audible signal apparatus which is placed in proximity to a building exit, such as a door, window, ladder, etc., to guide one or more fire fighters or emergency personnel to the exit during conditions of intense smoke and heat.

BACKGROUND OF THE INVENTION

Fire fighters and emergency personnel operating inside burning buildings may become disorientated or lost due to large volumes of smoke and heat. With loss of direction and a limited air supply, finding an exit becomes a matter of life and death. Many fire fighters and civilians die each year in fires by getting disorientated in smoke filled structures, and not being able to find their way to safety.

Some fire fighting units position a fire fighter at an exit of a burning building with a flashlight, to help guide the fire fighters to the exit. Flashlights are an inefficient means of providing a visual signal, as the intensity of light generated by a flashlight has difficulty penetrating heavy smoke, and the light only shines in the direction in which the flashlight is pointed.

The fire fighter positioned at an exit of a burning building may also shout every few seconds, in an attempt to provide an audible signal to aid in directing fire fighters to an exit. Because it is difficult to differentiate the sound of voices in an emergency situation, the shouts of others directing the fire fighting effort may become mixed with the shouts of the fire fighter at the exit. This adds to the confusion, and may lead a disorientated fire fighter away from the exit towards shouts located outside, or in other parts of the building where no exit exists.

U.S. Pat. No. 4,090,185 issuing to Richard Patty on May 16, 1978 discloses an emergency position-fixing device which is removably mounted to a fireman's helmet or equipment. This unit is carried by each fireman, and provides a high intensity strobe light to signal the position of each of the fireman. This unit is further designed to actuate a position fixing sound when the signaling device is detached from the carrier. This is helpful in locating a fireman in distress within a burning building, but is not intended for use in locating an exit.

U.S. Pat. No. 4,468,656 issuing to Thomas Clifford et. al on Aug. 28, 1984 discloses an emergency signalling unit and alarm system for rescuing endangered workers. This unit is carried by each worker, with an alarm sounding at a central station when a worker becomes endangered, providing a signal at the central station showing which worker is endangered.

U.S. Pat. No. 4,288,784 issuing to Andrew Fusco on Sep. 8, 1981 discloses a light and alarm device for mounting to a wall or post. The unit provides a dusk to dawn security light, a selectively actuated rotating signal light, and an audibly actuated siren. The security light is extinguished upon actuation of the audible alarm.

While these prior art devices are the closest known prior art to applicant's invention, they do not teach nor make obvious the combined advantages of visually signaling the location of an exit in a burning building; the use of a first distinctive audible signal for leading fire fighters to an exit in a smoke filled environment; the use of a second distinctive audible signal for indicating that the temperature in proximity to the portable signal apparatus has reached a preset danger level; and the use of a third distinctive audible signal which may be actuated by a hand held transmitter carried by each of the firemen, that will transmit the third distinctive audible signal as long as the user actuates the hand held transmitter.

DEFINITIONS

For purposes of this disclosure, the following terms are defined as follows:

WATER-RESISTANT: Capable of withstanding falling water in the form of a spray or downpour for a period of one hour, without affecting the subsequent operation of the invention.

WATERPROOF: Capable of immersion or submersion in water for a period of one hour, without affecting the subsequent operation of the invention.

SAFE EXIT: A means of safe egress into and out of a building, such as a doorway, window, ladder, etc. during an emergency where smoke, fire, loss of breathable air, or other emergency condition is present.

SUMMARY OF THE INVENTION

A portable safety light and audible signal apparatus has a housing for containing a first distinctive audible timed response signal, a second distinctive audible signal responsive to a selected temperature range in proximity to the portable safety light and audible signal apparatus, a third distinctive audible signal responsive to a hand held transmitter carried by the user, and a visual signal apparatus mounted above the housing, with at least one switch means for selectively actuating the audible timed response signal and the visual signal apparatus.

BRIEF DESCRIPTION OF THE DRAWINGS

The above mentioned and other features and objects of this invention and the manner of attaining them will become more apparent and the invention itself will be best understood by reference to the following description of the invention, when considered in conjunction with the accompanying drawings, wherein.

DETAILED DESCRIPTION OF THE PREFERRED EMBODIMENTS

The portable safety light and audible signal apparatus 10 disclosed herein is particularly adapted for use by fire fighters and other emergency personnel, who have a need to return to a safe exit, such as a door, window, latter, etc., during smoke, fire, loss of breathable air, or other emergency situation.

Figure 1:
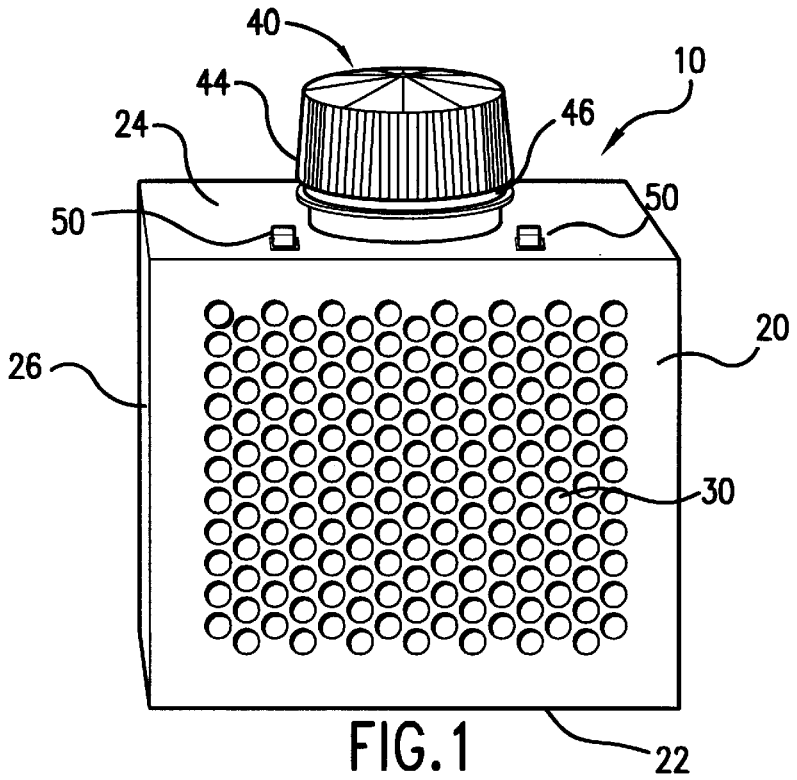
FIG. 1 is a perspective view of the portable safety light and audible signal apparatus.

The portable safety light and audible signal apparatus 10 shown in FIG. 1 comprises a housing 20 which is preferably water-resistant or waterproof. The housing 20 comprises a bottom portion 22, a top portion 24 disposed in spaced relation from the bottom portion 22, and at least one side portion 26 extending between the bottom portion 22 and the top portion 24, forming an enclosure therebetween. The side portion 26 may be cylindrical, rectangular, multi-sided, or any known structural shape suitable for its intended use.

An audible signal generating means 30 is disposed within the housing 20. The audible signal generating means 30 is preferably capable of generating a first distinctive audible sound of approximately one to three seconds duration, repeating every ten to 30 seconds. The first distinctive audible sound is preferably a multi-pitch sound, which is preferably from about 90 to 120 decibels, with about 100 to 110 decibels being most preferred. The first loud audible signal is preferably timed to be 110 decibels of one to three second duration, cycled every 12 to fourteen seconds, to allow other users to shout commands, receive instructions, etc. between the repetitive audible sounds generated by the portable safety light and audible signal apparatus 10.

The audible signal generating means 30, is preferably also capable of producing a second distinctive audible sound, which is actuated when the temperature in proximity to a heat sensor 56 mounted to the waterproof housing 20, reaches a pre-selected temperature.

Preferably, the pre-selected temperature is capable of being selectively set at 130 to 190 degrees Ferinheight. The second distinctive audible sound is distinctive from the first audible sound, so that emergency personnel are alerted to an increase in temperature at the exit location, so that they may hastily retreat through the safe exit, or find an alternate safe exit.

The second distinctive audible sound is preferably an intermittent sound of 90 to 120 decibels, such as a repetitive beep or shriek of about one-half to one second duration, repeated about every one to five seconds. Alternately, the second distinctive audible sound may be produced by a second distinctive sound generating means 58.

The audible signal generating means 30 is also preferably capable of producing a third distinctive audible sound. An internal receiver 32, such as a radio receiver, having a plurality of programmable codes is responsive to individual hand held transmitters 90, 92, 94, 96, etc., such as radio transmitters, are carried by the firemen and other emergency personnel. A different programmable code may be used by individual emergency crew members, or by selected fire fighting or emergency teams, to identify specific personnel or emergency crews, during use. Thus, the third distinctive sound generated by the signal generating means 30 may be distinctive to each individual transmitter 90, 92, 94, 96 etc. used, and is preferably 90 to 120 decibels.

The third distinctive sound is actuated by any of the transmitters 90, 92, 94, 96 etc. carried by the fire fighters and other emergency personnel, and remains actuated as long as one of the transmitters 90, 92, 94, 96, etc. is actuated by the user. This third distinctive sound enables the user to better position themselves, and also lets other emergency personnel know that someone is lost, injured, or in need of help.

Figure 4:
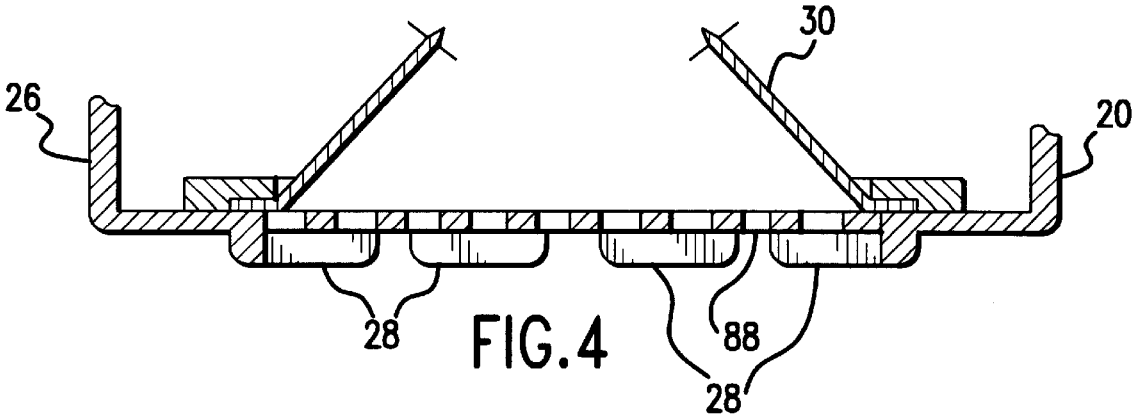
FIG. 4 is a cross sectional view of the waterproof housing, showing raised portions which allow the audio signal to escape, even when the housing is placed with the speaker face down.

As shown in cross section in FIG. 4, raised portions 28 extend about the audible signal generating means 30 to allow the sound to escape the housing 20 even when the portable safety light and audible signal apparatus 10 is tipped or knocked onto its side with the audible signal generating means 30 facing down.

The portable safety light 40 is preferably a strobe light 48 which is preferably mounted upon the top portion 24 of the housing 20. The strobe light 48 preferably provides a flashing and/or rotating visual signal, which is preferably about 100,000 to 200,000 candle power, which flashes about 60 to 100 flashes per minute. The strobe light 48 is mounted within a receptacle mounted upon the housing 20 to aid in the visual location of the portable safety light and signal apparatus 10, which has been positioned in proximity to a safe exit from the building.

The strobe light 48 is preferably a high intensity flashing and/or rotating light beam for maximum penetration of smoke filled areas of a building, and for maximum directional orientation. The strobe light 48 extends substantially 360 degrees within a building to provide a penetrating light visible from any point in the room in which it is placed.

A different colored lens 44 having a top and raised sides may be used to enclose the strobe light 40, to indicate a specific location within a building. Where more than one fire department or emergency team are at the same emergency location, a different colored lens 44 may be used to identify the different exit locations for each emergency team. The selected colored lens 44 may be yellow, blue, green, red, amber, clear, or any known color to suit emergency conditions, or to coordinate and differentiate with other lighting sources being used in the vicinity.

Preferably the strobe light 48 and colored lens 44 is enclosed in a water resistant or waterproof receptacle 46 mounted upon the housing 20, to protect the strobe light 48 against flooding, or from a direct spray from a fire hose, etc.

One or more switch means 50 may be positioned on the waterproof housing 20 to control the actuation of the strobe light 48 and one or more of the distinctive sounds generated by the audible signal generating means 30.

Figure 3:
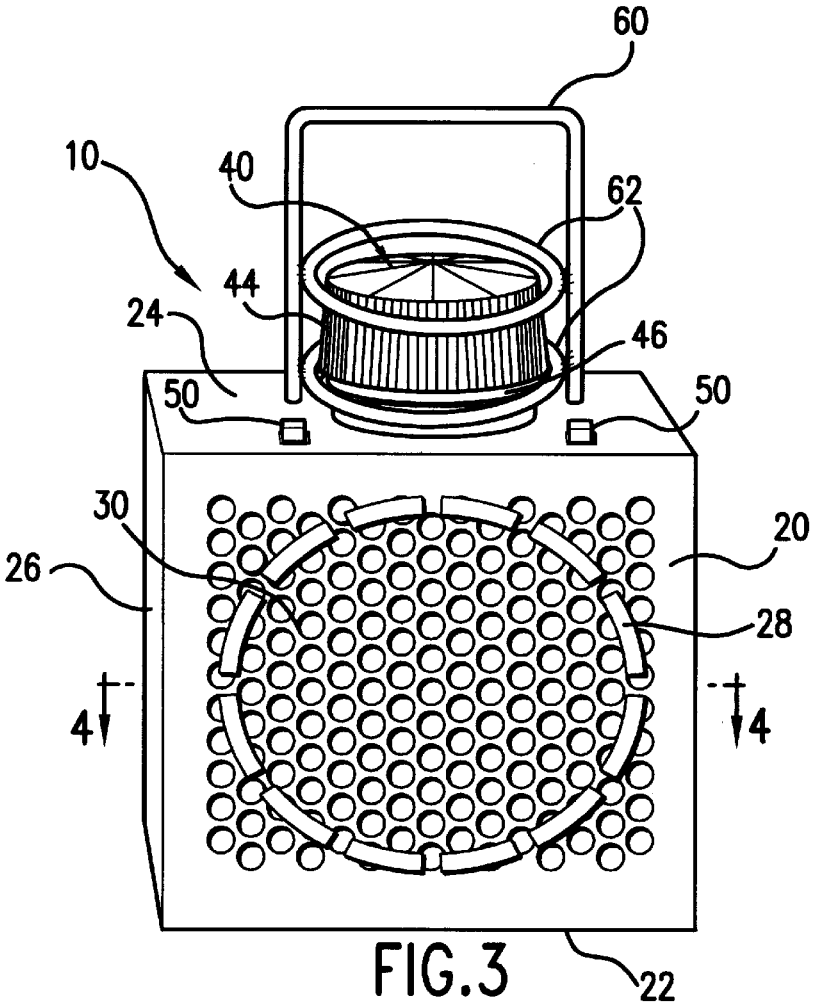
FIG. 3 is a perspective view of the portable safety light and audible signal apparatus showing a handle mounted about the portable safety light to provide additional protection during transportation, use and storage.

A handle 60 preferably extends above the housing 20 for ease of transporting the portable safety light and audible signal apparatus 10. The handle 60 preferably has two spaced rings 62, which are secured in spaced relation about the safety light 40 receptacle 46, as shown in FIG. 3. The handle 60 provides added protection to the safety light 40 during use, transport and storage.

A portable power means 52 is disposed within the housing 20, to provide suitable power to the strobe light 40, to the audible signal generating means 30, and to other electronic components located within the housing 20. The portable power means 52 is preferably a commercially available rechargeable battery 54, which is preferably rechargeable in a manner well known in the art. The battery 54 is preferably rechargeable from a 12 volt source, such as found on most safety and fire fighting vehicles (not shown), although the rechargeable battery 54 may be adaptable for recharging at other voltage sources, such as a 24 volt, 110 volt, or 220 voltage source, or other available voltage sources, to suit design and manufacturing preference.

Figure 2:
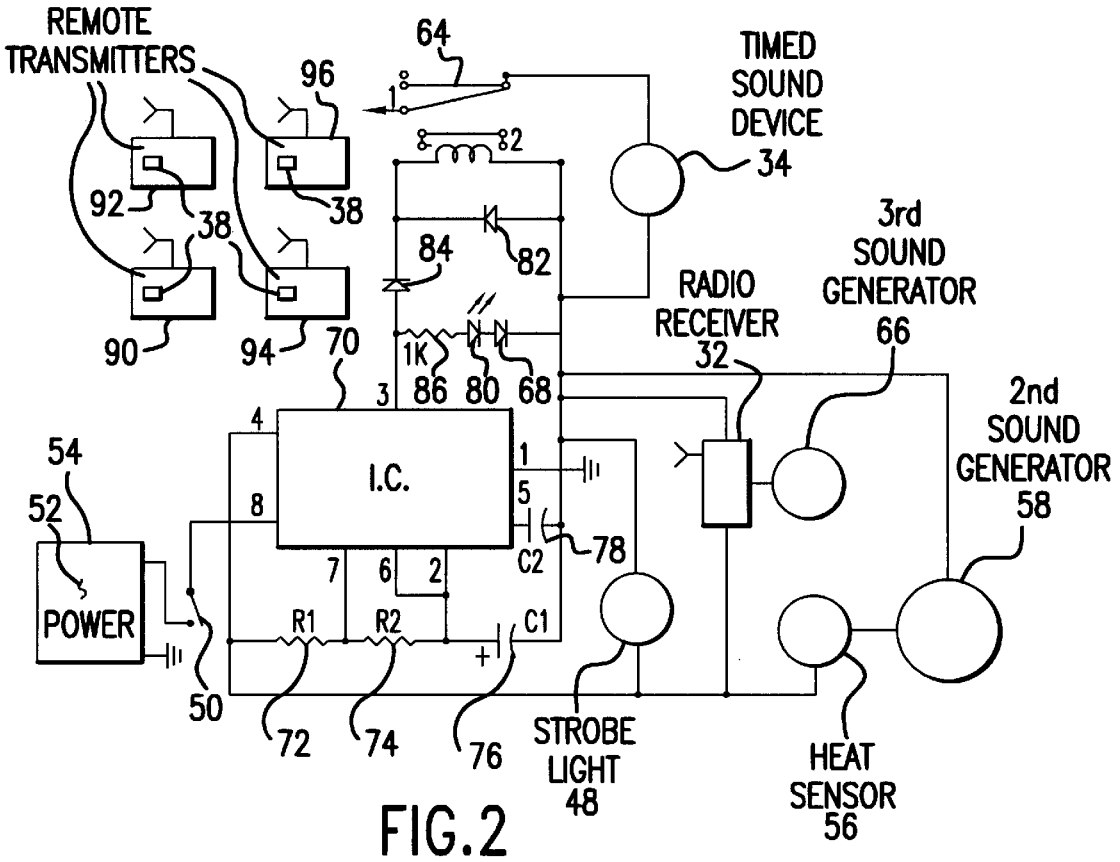
FIG. 2 is a schematic diagram of the combined portable safety light and audible signal apparatus, showing a plurality of remote hand held signaling apparatus.

The schematic shown in FIG. 2 is representative of one embodiment of the invention. One of average skill in this art is capable of designing other schematics which will also accomplish the desired results disclosed herein, and such alternate schematic embodiments are intended to fall within the scope of this disclosure, and the accompanying claims.

Referring now to the schematic of FIG. 2, one embodiment of this invention comprises a timing circuit 70, such as a commercially available 555 integrated circuit (I.C.), having 8 terminals. Terminal 1 connects to ground. Terminal 5 connects to the positive side of capacitor 78 (C2), which for example may be a 0.01 uf capacitor. The negative side of capacitor 78 (C2) connects to ground. The negative side of capacitor 76 (C1), which for example may be a 4.7 uf capacitor, also connects to ground, and the positive side of capacitor 76 (C1) connects to pin 2 and pin 6 of timing circuit 70. The positive side of Capacitor 76 (C1) also connects to the first side of resistor 74 (R2). The second side of resistor 74 (R2) connects to terminal 7, and to the first side of resistor 72 (R1). The second side of resistor 72 (R1) connects to terminals 8 and 4, and to switch 50, to radio receiver 32, and to the positive side of strobe light 40.

A plurality of remote transmitters, individually represented by 90, 92, 94, 96, etc. in the Schematic of FIG. 2, are carried by individual fire fighters or emergency personnel, and each remote transmitter 90, 92, 94, 96, etc. includes a transmitter actuation means 38. When the transmitter actuation means 38 is actuated, the signal from the remote transmitter 90, 92, 94, 96, etc. is received by a receiver 32, which is wired to produce the third distinctive audible signal from the audible signal generating means 30. The remote transmitter and receiver may communicate by radio transmission, ultra-sonic transmission, radar transmission, or by other known transmission means.

Alternately, a third distinctive sound generator means 66 may be a separate sound generator means 66 mounted within the housing 20. The third distinctive sound is a different and distinctive sound from the first and second distinctive sounds. The third distinctive sound may be a different distinctive sound for each of a plurality of transmitters 90, 92, 94, 96, etc.

The ground signal is also connected to the negative side of the strobe light 48, to one side of LED 80 and to the negative side of diode 82 (which may be a commercially available 1N914 diode).

Ground is also attached to the first side of a relay coil 64, which is preferably a 12 V relay coil. The opposite side of the relay coil 64 is connected to the positive side of diode 82, and to the positive side of diode 84. Diode 84 is preferably a commercially available 1N914 diode. The negative side of diode 84 is connected to terminal 3 on I.C. 70 and to one side of resistor 86, which is preferably a 1K resistor. The opposite side of resistor 86 is connected to an LED 80, which serves as a battery power and condition indicator. The opposite side of LED 80 is connected to a zenier diode 68, which provides about a 10 V cut-off. The opposite side of the zenier diode 68 is connected to ground.

The audible signal generating means 30 includes a timed sound device 34 which is connected on one side to ground, and on the opposite side to the relay coil 64.

The heat sensor 56 is connected on one side to power, and on the opposite side to the second distinctive sound generator means 58, which serves as a high heat warning signal. The opposite side of the second distinctive sound generator means 58 is connected to ground.

The electrical components referenced herein may be made water-resistant or waterproof by encapsulating the electrical components in a waterproof medium, such as plastic or rubber, or by selecting water-resistant or waterproof components, or by providing a water-resistant or waterproof housing to enclose the electrical components, or by other means known in the art, and such use is intended to fall within the scope of this disclosure, and the following claims.

While the schematic disclosed above is representative of one embodiment of this invention, one skilled in this art may readily modify this schematic without departing from the scope of this invention and the accompanying claims. By way of example, the first, second and third distinctive sounds may be generated by a single audible signal generating means 30, or from individual first, second and/or third audible sound generating means 31, 58, 66, and such modifications are intended to fall within the scope of this disclosure, and the following claims.

In use, the portable safety light and audible signal apparatus 10 is positioned in proximity to a safe exit, such as a doorway, window or ladder, etc., providing a safe exit from a burning or smoke filled building. Fire fighters, or other emergency users, may then enter a burning or smoke filled building, to perform rescue operations, and to fight the fire, as needed. The portable safety light and audible signal apparatus 10 is actuated by at least one switch means 50 to provide both a high intensity strobe light 48, and a first distinctive repetitive audible signal. The combination of high intensity strobe light 48 and the first distinctive repetitive audible signal provides a known reference point to enable emergency personnel to locate a safe exit in an emergency.

When the temperature in proximity to the portable safety light and audible signal apparatus 10 reaches a preset temperature limit, a second distinctive audible signal is generated to inform the emergency team to beat a hasty retreat through the safe exit, or to find an alternate safe exit.

Emergency personnel may each carry a transmitter 90, 92, 94, 96, etc. which when actuated, sends a signal to the receiver 32, which causes the third repetitive audible signal to actuate, to generate a third distinctive sound, signaling to others that an emergency condition exists, while providing an additional audible signal to aid the user in finding their way to a safe exit from the building. The third distinctive sound is actuated as long as the actuation means 38 on any one of the remote transmitters 90, 92, 94, 96, etc. is actuated.

The raised portions 28 extending from the housing 20 in proximity to the audible signal generating means 30, serve to ensure that the distinctive sounds will be heard, even if the portable safety light and audible signal apparatus is tipped over, with the audible signal generating means positioned adjacent to the ground.

The handle 60 provides additional protection to the strobe light 48 during transport, use and storage. The portable safety light and audible signal apparatus 10 is preferably recharged from a 12 volt emergency vehicle source, or may be recharged from a 24, 110 volt or 220 volt, or other available voltage source, to suit design and manufacturing preference. The preferred use of a water-resistant or waterproof housing, serves to protect the portable safety light and audible signal apparatus 10 during use where water, spray and other fire fighting fluids may come in contact with the apparatus during use.

Thus, while the portable safety light and audible signal apparatus 10 has been fully described and disclosed, numerous modifications will become apparent to one of ordinary skill in this art, and such adaption and modifications are intended to be included within the scope of the following claims:

We claim:

1. A portable safety light and audible signal apparatus, comprising:

a) a housing having a bottom portion, a top portion and at least one side portion forming an enclosure therebetween;

b) an audible signal generating means disposed within the housing, the audible signal generating means capable of generating a first distinctive audible signal at a level of 90 to 120 decibels for one to three seconds duration, which is repeated every 10 to 30 seconds;

c) a strobe light located within a receptacle mounted upon the top portion of the housing;

d) at least one switch means secured to the housing, the switch means in electrical communication with the strobe light and the audible signal generating means, for selectively actuating the strobe light and the audible signal generating means;

e) a portable power means located within the enclosure, the portable power means in electrical communication with the switch means; and f) an internal radio receiver located within the housing, with at least one remote transmitter in radio communication with the internal radio receiver, the transmitter being remotely actuated to generate a distinctive audible signal by the audible signal generating means, to provide additional orientation signaling in an emergency, and to alert others of an emergency condition.

2. The portable safety light and audible signal apparatus of claim 1, wherein a temperature sensor is configured to selectively actuate the audible signal means to produce a second distinctive intermittent audible sound when the temperature surrounding the housing exceeds a pre-determined temperature, selected from a range of 130 to 190 degrees F.

3. The portable safety light and audible signal apparatus of claim 1, wherein at least one colored lens is removably secured about the strobe light, to selectively color the strobe light for purposes of identification.

4. The portable safety light and audible signal apparatus of claim 1, wherein the first distinctive repetitive audible signal is a multi-pitch sound.

5. The portable safety light and audible signal apparatus of claim 1, wherein the audible signal apparatus preferably produces a programmable audible signal responsive to a plurality of remote individual hand held transmitters, the third programmable audible signal producing a sound which is distinctive for each of the remote hand held transmitters.

6. The portable safety light and audible signal apparatus of claim 1, wherein an inverted U shaped handle is positioned with sides extending upwardly on opposing sides of the strobe light, with at least one security ring secured to the handle sides in spaced relation about the strobe light to provide additional protection to the strobe light during use, transport and storage.

7. The portable safety light and audible signal apparatus of claim 1, wherein at least one raised intermittent ridge extends about the audible signal generating means to allow audible sounds to escape even when the portable safety light and audible signal apparatus is turned on its side, with the audible signal means adjacent to the floor.

8. The portable safety light and audible signal apparatus of claim 1, wherein the portable electrical power means is rechargeable.

9. The portable safety light and audible signal apparatus of claim 1, wherein the portable safety light and audible signal apparatus is water-resistant.

10. The portable safety light and audible signal apparatus of claim 1, wherein the portable safety light and audible signal apparatus is waterproof.

11. A portable safety light and audible signal apparatus designed for use in a hazardous environment, comprising:

a) a water resistant housing having a bottom portion, a top portion and at least one side portion forming an enclosure therebetween;

b) an audible signal generating means disposed within the housing, the audible signal generating means capable of generating at least two distinctive audible signals at a level of 90 to 130 decibels, the first distinctive audible signal of about one to three seconds duration, repeated every six to 30 seconds to provide an orientation signal, the second distinctive audible signal generated when a heat sensor detects a temperature in proximity to the housing which exceeds a pre-determined temperature selected from about 130 to 190 degrees F. to selective actuate the audible signal generating means to produce the second distinctive audible signal;

c) a rotatable strobe light located within an receptacle mounted upon the top portion of the housing, the strobe light producing approximately 50 to 120 flashes per minute at approximately 100,000 to 200,000 candle power, the rotatable strobe light having at least one lens which is removably secured about the strobe light to selectively color the light from the strobe light for purposes of identification;

d) at least one switch means secured to the housing, the switch means in electrical communication with the strobe light and the audible signal generating means, for selectively actuating the strobe light and the first audible signal generating means; and e) a rechargeable portable electrical power means disposed within the enclosure, the portable electrical power means in electrical communication with the switch means.

12. The portable safety light and audible signal apparatus of claim 11 wherein the audible signal apparatus preferably produces a third programmable audible signal responsive to a plurality of remote individual hand held transmitters, the third programmable audible signal produces a sound which is distinctive for each of the remote hand held transmitters.

13. The portable safety light and audible signal apparatus of claim 11, wherein an internal receiver is located within the housing, and at least one remote transmitter is in communication with the internal receiver, and the remote transmitter is actuated to generate a third distinctive audible signal to provide additional orientation signaling in an emergency, and to alert others of an emergency condition.

14. The portable safety light and audible signal apparatus of claim 11, wherein the portable safety light and audible signal apparatus is waterproof.

15. A portable safety light and audible signal apparatus, comprising:

a) a water-resistant housing having a bottom portion, a top portion and at least one side portion forming a water-resistant enclosure therebetween;

b) an audible signal generating means disposed within the water-resistant housing, the audible signal generating means capable of producing at least three distinctive audible signals, each distinctive audible signal responsive to a pre-selected condition; the first distinctive audible signal a multi-pitch sound of about one to three seconds duration repeated about every 12 to 14 seconds at about 110 decibels, a second distinctive signal responsive to an increase of temperature in proximity to the water-resistant housing, selected from a range of from 130 to 190 degrees F.; an internal receiver located within the water-resistant housing, and at least one small remote transmitter in communication with the internal receiver, the small transmitter remotely actuated to generate a third distinctive series of audible signals to provide additional orientation signaling in an emergency, and to alert others of an emergency condition;

c) a rotatable strobe light located within a receptacle mounted upon the top portion of the water-resistant housing;

d) at least one switch means secured to the water-resistant housing, the switch means in electrical communication with the strobe light, the audible signal generating means and the internal receiver, for selectively actuating the strobe light, the audible signal generating means and the internal receiver; and e) a rechargeable portable electric power means in electrical communication with the switch means.

16. The portable safety light and audible signal apparatus of claim 15, wherein at least one colored lens is removably secured about the strobe light, to color the light from the strobe for purposes of identification.

17. The portable safety light and audible signal apparatus of claim 15, wherein a handle extends upwardly on opposing sides of the strobe light from the water-resistant housing, with at least one concentric ring extending in spaced relation from the handles about the strobe light, to provide a portable carrying handle and to provide additional protection to the strobe light during transport, use and storage.

18. The portable safety light and audible signal apparatus of claim 15, wherein at least one raised intermittent ridge extends about the audible signal generating means to allow audible sounds to escape even when the portable safety light and audible signal apparatus is turned on its side, with the audible signal means adjacent to the floor.

* * * * *